US010682274B2

(12) United States Patent
Kaikenger et al.

(10) Patent No.: US 10,682,274 B2
(45) Date of Patent: Jun. 16, 2020

(54) LOBED FABRIC CLAMP FOR PATIENT POSITIONING APPARATUS

(71) Applicant: Hill-Rom S.A.S., Pluvigner (FR)

(72) Inventors: Philippe Kaikenger, Pluvigner (FR); Jean-Bernard Duvert, Auray (FR); Clementine Pirio, Nantes (FR); Thierry Flocard, Montpellier (FR); Pascal Guguin, Brech (FR)

(73) Assignee: Hill-Rom S.A.S., Pluvinger (FR)

( * ) Notice: Subject to any disclaimer, the term of this patent is extended or adjusted under 35 U.S.C. 154(b) by 0 days.

(21) Appl. No.: 16/713,276

(22) Filed: Dec. 13, 2019

(65) Prior Publication Data

US 2020/0113762 A1 Apr. 16, 2020

Related U.S. Application Data

(63) Continuation of application No. 15/190,754, filed on Jun. 23, 2016, now Pat. No. 10,561,555.

(30) Foreign Application Priority Data

Jun. 24, 2015 (EP) ..... 15305982

(51) Int. Cl.
*A61G 7/10* (2006.01)
*A61G 7/05* (2006.01)

(52) U.S. Cl.
CPC ..... *A61G 7/1026* (2013.01); *A61G 7/05* (2013.01); *A61G 7/1044* (2013.01); *A61G 7/1073* (2013.01)

(58) Field of Classification Search
CPC ..... A61G 7/10
(Continued)

(56) References Cited

U.S. PATENT DOCUMENTS 378,220 A 2/1888 Staples et al.
653,259 A 7/1900 Otto
(Continued)

FOREIGN PATENT DOCUMENTS

DE 19725293 3/1998
EP 0875228 11/1998
(Continued)

OTHER PUBLICATIONS

Extended EP Search Report for European Patent Application No. 15305982.9 dated Dec. 4, 2015 (7 pages).
(Continued)

*Primary Examiner* — Fredrick C Conley
(74) *Attorney, Agent, or Firm* — Barnes & Thornburg LLP

(57) ABSTRACT

A patient positioning element is provided for fitting to a patient support device having a base portion and a patient support deck which may support a mattress with a sheet thereon. The patient positioning element includes at least one fixing element for fixing to a patient support deck, a bar element for holding a sheet in position and at least one connector element transverse to the bar for connecting or coupling the bar to the fixing element. The connector element is adjustable such that the bar may take up a first storage position adjacent or near the fixing element and a second deployed position adjacent or near the upper surface of a mattress. The patient support deck is moveable upwardly and downwardly relative to the base portion. The patient is repositioned by a method comprising: locating the head end of a sheet on the mattress under a bar at the head end of the patient support device and adjacent the head end of the mattress; fixing the head end of the sheet to the head board or head frame; and then lowering the head end of the patient support deck such that the sheet is pulled under the
(Continued)

bar and then upwards and away from the head end of the mattress.

13 Claims, 11 Drawing Sheets

(58) Field of Classification Search
USPC ..... 5/81.1 R, 81.1 HS, 88.1
See application file for complete search history.

(56) References Cited

U.S. PATENT DOCUMENTS

| | | | |
|---|---|---|---|
| 716,886 | A | 12/1902 | Goode |
| 1,085,879 | A | 2/1914 | Skeffington |
| 1,263,611 | A | 4/1918 | Scroggin |
| 1,981,666 | A | 11/1934 | Ridley |
| 2,528,048 | A | 10/1950 | Gilleland |
| 2,536,707 | A | 1/1951 | Allyn |
| 2,630,583 | A | 3/1953 | Gilleland |
| 2,665,432 | A | 1/1954 | Butler |
| 2,710,975 | A | 6/1955 | Stoen et al. |
| 2,733,452 | A | 2/1956 | Tanney |
| 2,809,381 | A | 10/1957 | Colander, Sr. |
| 2,812,524 | A | 11/1957 | Pruitt |
| 2,827,642 | A | 3/1958 | Huff |
| 3,049,726 | A | 8/1962 | Getz |
| 3,108,290 | A | 10/1963 | Partridge |
| 3,363,269 | A | 1/1968 | Kossuth |
| 3,418,670 | A | 12/1968 | Morgan |
| 3,562,824 | A | 2/1971 | White |
| 3,597,774 | A | 8/1971 | Warren |
| 3,694,830 | A | 10/1972 | Koller |
| 3,750,199 | A | 8/1973 | Spivey |
| 3,769,642 | A | 11/1973 | Warman |
| 3,829,914 | A | 8/1974 | Treat |
| 3,850,379 | A | 11/1974 | Stern |
| 3,877,089 | A | 4/1975 | Spivey et al. |
| 3,905,055 | A | 9/1975 | Blair |
| 4,077,073 | A | 3/1978 | Koll et al. |
| 4,092,748 | A | 6/1978 | Ewers |
| 4,156,946 | A | 6/1979 | Attenburrow |
| 4,194,253 | A | 3/1980 | Ullven |
| 4,195,375 | A | 4/1980 | Paul |
| 4,202,063 | A | 5/1980 | Murray |
| 4,296,509 | A | 10/1981 | Simmons et al. |
| 4,459,712 | A | 7/1984 | Pathan |
| 4,536,903 | A | 8/1985 | Parker |
| 4,558,847 | A | 12/1985 | Coates |
| 4,644,595 | A | 2/1987 | Daniel |
| 4,679,259 | A | 7/1987 | DiMatteo et al. |
| 4,680,818 | A | 7/1987 | Ooka et al. |
| 4,700,415 | A | 10/1987 | DiMatteo et al. |
| 4,726,082 | A | 2/1988 | DiMatteo et al. |
| 4,739,526 | A | 4/1988 | Hollick |
| 4,747,170 | A | 5/1988 | Knouse |
| 4,761,841 | A | 8/1988 | Larsen |
| 4,776,047 | A | 10/1988 | DiMatteo |
| 4,796,313 | A | 1/1989 | DiMatteo et al. |
| 4,819,283 | A | 4/1989 | DiMatteo et al. |
| 4,821,352 | A | 4/1989 | DiMatteo et al. |
| 4,837,872 | A | 6/1989 | DiMatteo et al. |
| 4,837,873 | A | 6/1989 | DiMatteo et al. |
| 4,847,930 | A | 7/1989 | Späth |
| 4,868,938 | A | 9/1989 | Knouse |
| 4,887,325 | A | 12/1989 | Tesch |
| 4,941,220 | A | 7/1990 | DiMatteo et al. |
| 5,018,225 | A | 5/1991 | Fergni et al. |
| 5,038,424 | A | 8/1991 | Carter et al. |
| 5,054,140 | A | 10/1991 | Bingham et al. |
| 5,068,931 | A | 12/1991 | Smith |
| 5,072,840 | A | 12/1991 | Asakawa et al. |
| 5,080,950 | A | 1/1992 | Burke |
| 5,127,113 | A | 7/1992 | Di Matteo et al. |
| 5,165,122 | A | 11/1992 | Phalen |
| 5,168,587 | A | 12/1992 | Shutes |
| 5,239,713 | A | 8/1993 | Toivio et al. |
| 5,274,862 | A | 1/1994 | Palmer, Jr. et al. |
| 5,280,657 | A | 1/1994 | Stagg |
| 5,319,813 | A | 6/1994 | DiMatteo et al. |
| 5,327,593 | A | 7/1994 | Burnett |
| 5,379,468 | A | 1/1995 | Cassidy et al. |
| 5,390,379 | A | 2/1995 | Palmer, Jr. et al. |
| 5,390,380 | A | 2/1995 | James-Wallace |
| 5,406,658 | A | 4/1995 | Olkkonen et al. |
| 5,456,655 | A | 10/1995 | Morris |
| 5,469,588 | A | 11/1995 | DiMatteo et al. |
| 5,490,298 | A | 2/1996 | Goldsmith et al. |
| 5,524,304 | A | 6/1996 | Shutes |
| 5,539,941 | A | 7/1996 | Fuller |
| 5,544,371 | A | 8/1996 | Fuller |
| 5,608,929 | A | 3/1997 | Crane |
| 5,613,252 | A | 3/1997 | Yu et al. |
| 5,651,149 | A | 7/1997 | Garman |
| 5,659,905 | A | 8/1997 | Palmer, Jr. et al. |
| 5,673,443 | A | 10/1997 | Marmor |
| 5,697,109 | A | 12/1997 | Hodgetts |
| 5,720,685 | A | 2/1998 | Malone |
| 5,737,781 | A | 4/1998 | Votel |
| 5,819,339 | A | 10/1998 | Hodgetts |
| 5,850,642 | A | 12/1998 | Foster |
| 5,890,238 | A | 4/1999 | Votel |
| 5,901,388 | A | 5/1999 | Cowan |
| 5,937,456 | A | 8/1999 | Norris |
| 5,996,144 | A | 12/1999 | Hodgetts |
| 6,065,162 | A | 5/2000 | Behr |
| 6,163,906 | A | 12/2000 | Kay |
| 6,196,229 | B1 | 3/2001 | Piazza |
| 6,282,734 | B1 | 9/2001 | Holberg |
| 6,289,533 | B1 | 9/2001 | Hodgetts |
| 6,363,555 | B1 | 4/2002 | LaRose |
| 6,378,148 | B1 | 4/2002 | Votel |
| 6,496,991 | B1 | 12/2002 | Votel |
| 6,507,693 | B2 | 1/2003 | Hodgetts |
| 6,539,569 | B2 | 4/2003 | O'Connell |
| 6,591,435 | B1 | 7/2003 | Hodgetts |
| 6,615,423 | B2 | 9/2003 | Sverdlik et al. |
| 6,629,323 | B2 | 10/2003 | Sverdlik et al. |
| 6,659,935 | B2 | 12/2003 | Costanzo |
| 6,662,388 | B2 | 12/2003 | Friel et al. |
| 6,675,411 | B1 | 1/2004 | Javier |
| 6,772,456 | B2 | 8/2004 | Votel |
| 7,003,819 | B2 | 2/2006 | Weigand |
| 7,007,330 | B2 | 3/2006 | Kuiper et al. |
| 7,111,338 | B2 * | 9/2006 | Faux ..... A61G 7/1019 5/81.1 C |
| 7,178,181 | B1 | 2/2007 | Fulmer |
| 7,290,299 | B2 | 11/2007 | Votel |
| 7,725,964 | B2 * | 6/2010 | Minning ..... A61G 7/0533 5/81.1 HS |
| 1,056,155 | A1 | 2/2020 | Kaikenger et al. |
| 2001/0008028 | A1 | 7/2001 | Blevins et al. |
| 2001/0044957 | A1 | 11/2001 | Hodgetts |
| 2002/0029418 | A1 | 3/2002 | Votel |
| 2002/0083521 | A1 | 7/2002 | Sverdlik et al. |
| 2002/0083522 | A1 | 7/2002 | Sverdlik et al. |
| 2004/0181871 | A1 | 9/2004 | McMahan |
| 2005/0138727 | A1 | 6/2005 | Faux et al. |
| 2006/0272884 | A1 | 12/2006 | Vilcek et al. |
| 2007/0056096 | A1 | 3/2007 | Assink |
| 2013/0174339 | A1 | 7/2013 | Stryker et al. |
| 2014/0096319 | A1 | 4/2014 | Moriarty et al. |
| 2014/0352058 | A1 | 12/2014 | Sverdlik et al. |
| 2016/0374882 | A1 | 12/2016 | Kaikenger et al. |

FOREIGN PATENT DOCUMENTS

| | | |
|---|---|---|
| GB | 2139487 | 11/1984 |
| WO | 95/21600 | 8/1995 |

(56) References Cited

FOREIGN PATENT DOCUMENTS

| | | |
|---|---|---|
| WO | 97/09896 | 3/1997 |
| WO | 98/44889 | 10/1998 |

OTHER PUBLICATIONS

Communication pursuant to Article 94(3) EPC for European Patent Application No. 15305982.9 dated Nov. 10, 2017 (6 pages).
Summons to attend oral proceedings pursuant to Rule 115(1) EPC for European Patent Application No. 15305982.9 (7 pages).
Decision to refuse a European Patent application for European Patent Application No. 15305982.9 dated Nov. 22, 2018 (10 pages).

* cited by examiner

Figure 10a
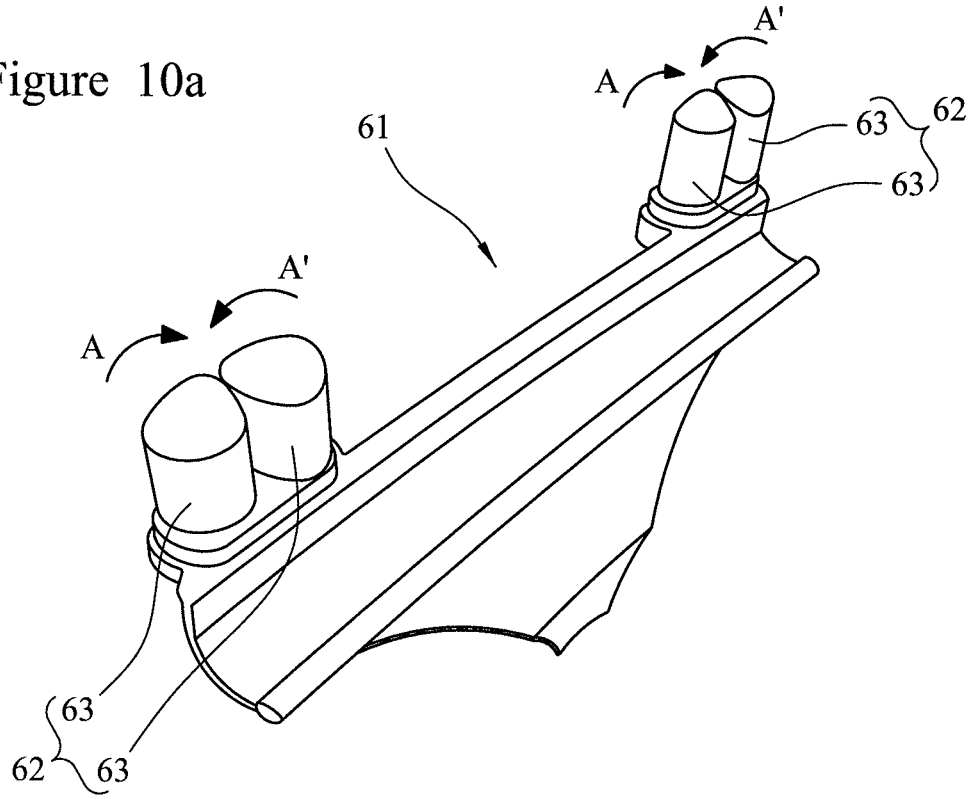
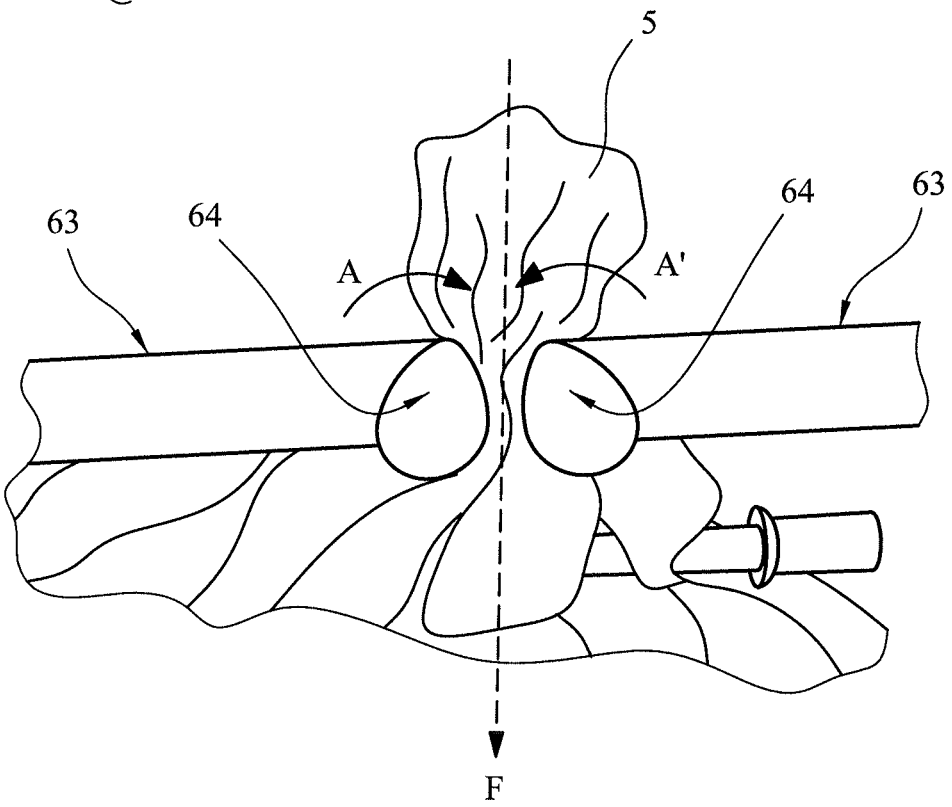
Figure 10b

LOBED FABRIC CLAMP FOR PATIENT POSITIONING APPARATUS

The present application is a continuation of U.S. application Ser. No. 15/190,754, filed Jun. 23, 2016, now U.S. Pat. No. 10,561,555, which claims priority, under 35 U.S.C. § 119(a), of European Application No. 15305982.9 which was filed Jun. 24, 2015 and each of which is hereby incorporated by reference herein.

BACKGROUND

The present disclosure relates to apparatus and methods for orienting or positioning a patient on a patient support device, such as a hospital bed. More particularly, the present disclosure relates to an apparatus for pulling a patient toward a head end of a patient support device.

Some patient support devices, such as hospital beds, stretchers, surgical tables, and the like, have mechanisms for articulating, raising, lowering and/or tilting a patient support portion of the device relative to a base of the device. When a head section of the patient support portion of the device is raised to move the patient from a supine position to a sitting position, it is not uncommon for the patient to slide down the head section and move toward a foot end of the device. Thus, the patient may be shifted too far toward the foot end of the patient support device when the head section is lowered back down to return the patient to the supine position. Some prior art devices, such as those shown in U.S. Pat. Nos. 5,608,929 and 5,280,657 and those shown in U.S. Patent Application Publication Nos. 2002/0083521 and 2002/0083522, include mechanisms for pulling a patient toward the head end of a hospital bed.

U.S. Pat. No. 8,407,831 discloses a patient positioning apparatus comprising a base, a support column, at least one positioning arm on the support column capable of being positioned over a bed and having a buckle and strap capable of securing to a patient support with a receiving buckle so that a patient can be partially or totally suspended when an adjustable bed is lowered. The apparatus further comprises a telescoping support column and horizontal support for holding a first and second positioning arm. The positioning arms further comprise locking pivots for extending and retracting. Patient repositioning is effectuated by positioning the arms over a patient, extending straps with buckle inserts into receiving buckles on a fabric gripper secured to bed linens. A patient positioning apparatus can further be mounted to either a ceiling or a wall or can comprise a swiveling support column.

The arrangement of U.S. Pat. No. 8,407,831 requires a large additional frame mechanism which takes up considerable space near and/or around a patient support device such as a hospital bed and is time consuming, complicated and difficult for a care giver such as a nurse to use.

U.S. Pat. No. 5,280,657 and U.S. Patent Application Publication No. 2014/0259389 disclose patient positioning arrangements which pull a sheet on top of the mattress on which a patient is located. The head end of the sheet is gripped by a tether or cable arrangement which pulls the sheet downwards over the head end of the mattress. In U.S. Pat. No. 5,288,657 this pulling downwards of the sheet is done by movement of the mattress upwards relative to the base portion of the patient support device. In U.S. Patent Application Publication No. 2014/0259389, this downwards pulling of the sheet is done by a motor located underneath or within the mattress. Both of these arrangements involve significant frictional forces between the sheet and the mattress as the sheet is pulled along when in contact with both the top surface of the mattress and around the head end corner and then the head end side of the mattress. This makes it difficult to move the sheet and also results in significant shear forces on the skin of a patient on the patient support device. Such skin shear forces are to be avoided as they are uncomfortable even for patients without sensitive skin, and can be positively harmful for patients with sensitive skin or skin conditions.

SUMMARY

An apparatus, system or method may comprise one or more of the features recited in the appended claims and/or the following features which, alone or in any combination, my comprise patentable subject matter:

The present disclosure, in a first aspect, provides a patient positioning system for use with a patient support device having a base portion and a patient support deck which may support a mattress with a sheet thereon, the patient positioning system including a bar that is fixable to the head end of the patient support device and which is deployable to a position above or adjacent the patient support deck and allowing a sheet on the said mattress to pass thereunder, the system also including means for pulling the sheet on the mattress under the bar and then upwards and away from the head end of the mattress and towards the head end of the patient support device.

This arrangement allows for an easy and inexpensive system for repositioning a patient which does not take up space around the patient support device. Furthermore, the pulling of the sheet upwards and away from the head end of the mattresses reduced the force necessary to overcome friction between the mattress and the sheet.

Optionally, the bar is deployable to a position above or adjacent the upper surface of a mattress on the patent support deck.

Optionally, wherein the means for pulling the sheet away from the head end of the mattress and towards the head end of the patient support device includes a sheet gripper element located above the bar and the top of a mattress on the patient support deck, and a motor for pulling a sheet held in the gripper.

This arrangement allows an easy to use and inexpensive means for pulling the sheet which can be retro-fitted to an existing patient support device.

Alternatively, the patient support deck is movable upwardly and downwardly relative to the base portion and the means for pulling the sheet on the mattress under the bar and then upwards and away from the head end of the mattress and towards the head end of the patient support device includes a sheet gripper element located on a unit movable relative to the patient support deck as the patient support deck moves upwards and downwards.

Using the movement of the patient support deck avoids the need for additional motors and also allows for an easy to use and inexpensive arrangement for pulling the sheet to reposition a patient.

Optionally, the sheet gripper is fixable to the head end of the base portion at a location above the patient support deck.

Optionally, the sheet gripper is fixable to a head board or head end frame of the patient support device.

This allows for easy retro-fitting to an existing bed or patient support device.

Alternatively, the sheet gripper is fixable to a wall or other fixed surface adjacent the head end of the patient support device and above the patient support deck. The sheet gripper may be a fabric clamp according to other aspects of the present disclosure.

Optionally, the patient support device includes a pair of actuators for controlling the upwards and downwards movement of the patient support deck relative to the base portion, the actuators being controllable so that the patient support deck may be moved to take up flat positions with the head end of the patient support surface deck the foot end of the patient support deck, such that the sheet on the mattress when gripped in the sheet gripper may be pulled away from the head end of the mattress and towards the head end of the patient support device by downward movement of the head end of the patient support deck to take up a position with the head end below the foot end.

This arrangement makes use of actuators already present on many existing beds and is therefore relatively inexpensive and easy to retro-fit. The repositioning with the head end below the foot end also reduces patient skin shear effects or a patient is repositioned and is therefore particularly desirable for patients with sensitive skin.

Optionally, the bar is moveable between a first retracted position below the upper surface of the mattress and a second deployed position at or near the upper surface of the mattress.

Optionally, the bar includes a sheet bar unit comprising at least one fixing element for fixing to a patient support deck, and a connector element transverse to the bar for connecting or coupling the bar to the fixing element.

The disclosure, in a second aspect, provides a patient positioning element for fitting to a patient support device having a base portion and a patient support deck which may support a mattress with a sheet thereon, the patient positioning element comprising at least one fixing element for fixing to a patient support deck, a bar element for holding a sheet in position and at least one connector element transverse to the bar for connecting or coupling the bar to the fixing element, wherein the connector element is adjustable such that the bar may take up a first storage position adjacent or near the fixing element and a second deployed position adjacent or near the upper surface of a mattress.

Such a patient positioning element can easily be retrofitted to an existing bed and provides an easy to use and inexpensive patient positioning system and/or method.

Optionally, the connector element includes at least one strap coupling the bar to the fixing and the sheet bar unit includes a biasing or spring element for tensioning the at least one strap to bias or pull the bar towards the fixing element and hence patient support deck.

The disclosure, in a third aspect, provides a method of positioning a patient on a patient support device having a base portion and a patient support deck which is moveable upwardly and downwardly relative to the base portion and which supports a mattress with a sheet thereon, the method comprising:

i) locating the head end of a sheet on the mattress under a bar at the head end of the patient support device and adjacent the head end of the mattress;

ii) pulling the head end of the sheet under the bar and then upwards and away from the head end of the mattress.

Optionally, the patient support deck is moveable upwardly and downwardly relative to the base portion and which supports a mattress with a sheet thereon, including a head board or head frame unit at the head end of the bed and fixed to the base portion, the method comprising:

a) locating the head end of a sheet on the mattress under a bar at the head end of the patient support device and adjacent the head end of the mattress;

b) fixing the head end of the sheet to the head board or head frame; and c) lowering the head end of the patient support deck such that the sheet is pulled under the bar and then upwards and away from the head end of the mattress.

Optionally, the head end is lowered below the height of the foot end of the patient support surface.

Optionally, the bed is lowered from a flat raised position to the Trendelenburg position.

The disclosure, in a fourth aspect, provides a fabric clamp comprising a first clamp portion for clamping a fabric and a second mounting portion for mounting the clamp onto a patient support device, wherein the second mounting portion includes a mount for engagement with an opening or space in a portion of the patient support device, the mount including a pair of engaging surfaces for engaging edges of the opening or space and a support between and connecting the pair of engaging surfaces, and wherein a first one of the pair of engaging surfaces includes a first curved surface for contacting at least two sides of a first edge of the opening or device, and a second one of the pair of engaging surfaces includes a second curved surface for contacting at least two sides of the opening or device, one of the at least two sides of the two edges being a side facing into the opening or space, and another of the at least two sides of each of the pair of engaging surfaces facing in opposite directions.

The second mounting portion allows for easy retro-fitting of the fabric clamp to an existing bed or patient support device.

The first one of the pair of engaging surfaces may include a curved surface for contacting three sides of an edge of the opening or space, one of the sides being opposite the side facing into the opening or space. Optionally, the first one of the pair of engaging surfaces includes a C-shaped channel having a C-shaped surface for contacting three sides of an edge of the opening or space.

This may enable the first one of the pair of engaging surfaces to snap fit to an edge of the opening or space.

The C-shaped surface may not be continuous. In other words, the C-shaped channel may comprise two or more curved elements, the curved elements being spaced from each other along the length of the channel. The C-shaped channel may comprise three curved elements.

This may reduce the weight and cost of the fabric clamp by reducing the amount of material required to manufacture the clamp.

Optionally, the fabric clamp is formed from a resilient material with sufficient flexibility to enable the engaging surfaces of the second mounting portion to snap fit to the engaging edges of the opening or space. The support may be formed from a plastics or composite material, or thermoplastics that are suitable for food or pharmaceutical applications, for example polypropylene, polyetheretherketone (PEEK) and polyethylene. The material may be light and non-brittle.

The first one of the pair of engaging surfaces may be an upper surface, configured to engage with an upper edge of the opening or space and the second one of the pair of engaging surfaces may be a lower surface, configured to engage with a lower edge of the opening or space. Optionally, the mount is configured to be engaged with the opening or space by engaging the first, upper engaging surface with an upper edge of the opening or space in and pivoting the mount about the upper engaging surface to engage the second, lower engaging surface with a lower edge of the opening or space. This may facilitate positioning of the fabric clamp relative to the patient support, particularly for a bed, the upper engaging surface may be at a height that is more easily accessible to a caregiver in a standing position.

The fabric clamp may be fixable to a head board or head end frame of the patient support device. Optionally, the mount is configured for engagement with an opening or space in a head board of the patient support device.

Optionally, the first clamp portion is adapted for clamping a sheet of the patient support device. As such, the fabric clamp may be a sheet gripper according to other aspects of the present disclosure.

The first clamp portion may comprise a channel for receiving the fabric to be clamped and a locking element, the locking element being removably receivable in the channel and lockable within the channel for clamping the fabric between the channel and the locking element.

Optionally, the locking element comprises a protrusion and the channel comprises an opening configured to allow the protrusion to pass into the channel, and an upper edge configured to engage with the protrusion when the protrusion is received in the channel for locking the protrusion in the channel.

The locking element may be substantially L-shaped or T-shaped. The locking element may comprise a handle and one or more protrusions extending substantially perpendicular to the handle.

To position the locking element in the channel, a user may hold the locking element by the handle and insert the one or more protrusions into channel through the opening. The user may then rotate the locking element to engage the one or more protrusions with the upper edge of the channel to secure the locking element in place.

To clamp a fabric between the channel and the locking member, the locking element may be removed from the channel, a fabric may be draped over the opening of the channel, the one or more protrusions of the locking element may be inserted into the channel through the opening, pushing the fabric into the channel through the opening, and the one or more protrusions may be engaged with the upper edge of the channel to clamp the fabric between the one or more protrusions and the channel.

This provides a fabric clamp that is straightforward to use and enables a user to quickly clamp and quickly release a sheet of a patient support device, when required. The clamp also comprises two parts that are easy for a user to assemble and clean.

The disclosure, in a fifth aspect, provides a patient positioning system for use with a patient support device having a base portion and a patient support deck which may support a mattress with a sheet thereon, the patient positioning system including a bar that is fixable to the head end of the patient support device and may be deployed to a position above or adjacent the patient support deck and allowing a sheet on the said mattress to pass thereunder, the system also including means for pulling the sheet on the mattress under the bar and then upwards and away from the head end of the mattress and towards the head end of the patient support device, the means including: a fabric clamp according to the fourth aspect of the disclosure, the fabric clamp being located above the bar and the top of a mattress on the patient support deck, and a motor for pulling a sheet held in the fabric clamp.

The disclosure, in a sixth aspect, provides a fabric clamp for use with a patient support device, the fabric clamp comprising a first clamp portion for clamping a fabric and a second mounting portion for mounting the fabric clamp to a patient support device, wherein the first clamp portion comprises a cooperating pair of adjacent pin elements, one of the pin elements being rotatable and the pin elements being arranged such that the rotatable pin element is rotatable in a clamping direction into a clamping position in which the pin elements are in contact with each other and in an opening direction, opposite to the clamping direction, out of the locking position in which a gap is provided between the pin elements, the rotatable pin element comprising a biasing element biasing the rotatable pin element in the clamping direction towards the clamping position.

The second mounting portion may be similar or identical to the mounting portion of the fourth and fifth aspects of the present disclosure.

Optionally, the rotatable pin element is a cam. As used herein, the term cam refers to a rotatable element having an eccentric pivot or an eccentric or irregular form. For example, in some embodiments, the rotatable pin element has a circular shape with an axis of circular symmetry, and the axis of rotation of the rotatable pine element is offset from the axis of circular symmetry. In other embodiments, the rotatable pin element is a lobed pin element, having a lobe portion extending substantially radially outwardly from the center of rotation of the pin element, the rotatable pin element being arranged such that the lobe portion contacts the other pin element in the clamping position.

Optionally, the pin elements are formed from a resilient material, such as a plastics or composite material, or thermoplastics that are suitable for food or pharmaceutical applications, for example polypropylene, polyetheretherketone (PEEK) and polyethylene. The material may be light and non-brittle. The pin elements may be formed from the same material as the second mounting portion.

Optionally, at least the rotatable pin has an outer cover formed of elastomeric material. The outer cover may be formed of any suitable elastomeric material, such as rubber. The cover may provide a high friction surface to help the pins to grip a sheet disposed between them.

Optionally, the biasing element is a resilient element, such as a spring. The biasing element may be any suitable type of spring, such as a spiral torsion spring.

Optionally, the pin elements are arranged such that one or more sheets of fabric may be positioned between the pin elements and clamped between the pin elements as the rotatable pin is urged by the biasing element in the clamping direction towards the clamping position.

Optionally, the pin elements are arranged such that pulling the one or more clamped sheets of fabric in a first direction relative to the pin elements tends to draw the rotatable pin element in the clamping direction towards the clamping position.

Optionally, the pin elements are arranged such that pulling the one or more clamped sheets of fabric in a second direction relative to the pin elements, opposite the first direction, draws the rotatable pin element in the opening direction away from the clamping position.

Optionally, both pin elements are rotatable, and both pin elements comprise a biasing element biasing the pin element in a clamping direction towards the clamping position, the clamping direction of one of pin elements being opposite to the clamping direction of the other one of the pin elements. By rotating the pins in opposite directions, the adjacent surfaces of the pins move in the same direction as they pass the line connecting their centers of rotation. This means that the pins are moving in substantially the same direction, towards the line connecting their centers of rotation, when the pins make contact in the clamping position. This causes the pins push against each other in the clamping position, which facilitates clamping of a fabric between the pins.

Applying a force on a fabric clamped between the pins in the direction from the point of clamping towards the line connecting the centers of rotation of the pins will tend to rotate the pins in the clamping direction. This may increase the inward force provided by the pins on the fabric clamping the fabric in place.

Applying a force in the opposite direction will tend to rotate the pins in the opening direction, opposite the clamping direction. This may reduce the inward force provided by the pins on the fabric. This may make the clamp easy for a user to use, by providing a direction in which the user may insert the fabric easily between the pins and an opposite direction in which the fabric may be pulled to increase the clamping force on the fabric provided by the pins.

Optionally, the fabric clamp further comprises at least two cooperating pairs of adjacent pin elements. The pairs may be arranged at opposite ends or sides of the fabric clamp.

The fabric clamp may be fixable to a head board or head end frame of the patient support device. Optionally, the mount is configured for engagement with an opening or space in a head board of the patient support device.

Optionally, the first clamp portion is adapted for clamping a sheet of the patient support device. As such, the fabric clamp may be a sheet gripper according to other aspects of the present disclosure.

The disclosure, in a seventh aspect, provides a patient positioning system for use with a patient support device having a base portion and a patient support deck which may support a mattress with a sheet thereon, the patient positioning system including a bar that is fixable to the head end of the patient support device and may be deployed to a position above or adjacent the patient support deck and allowing a sheet on the said mattress to pass thereunder, the system also including means for pulling the sheet on the mattress under the bar and then upwards and away from the head end of the mattress and towards the head end of the patient support device, the means including: a fabric clamp according to the sixth aspect of the disclosure, the fabric clamp being located above the bar and the top of a mattress on the patient support deck, and a motor for pulling a sheet held in the fabric clamp.

Optionally, the fabric clamp comprises two cooperating pairs of adjacent pin elements.

The disclosure, in an eighth aspect, provides a fabric clamp for use with a patient support device, the fabric clamp comprising a first clamp portion for clamping a fabric and a second mounting portion for mounting the fabric clamp to a patient support device, wherein the first clamp portion comprises a cooperating pair of adjacent pivotable pin elements, wherein the pin elements are arranged to contact each other at a point displaced from the line connecting their respective centers of rotation, and wherein the pin elements each include a biasing element which biases them to push against each other and towards the line connecting their respective centers of rotation.

The second mounting portion may be similar or identical to the mounting portion of the fourth and fifth aspects of the present disclosure.

Optionally, the pin elements are shaped such that movement of fabric arranged between the pin elements substantially in the direction of the biasing of the pin elements, towards the line connecting the respective centers of rotation of the pin elements, draws the pin elements against each other and increases the clamping force of the pin elements on the fabric.

The pin elements may be substantially similar to the rotatable pin elements according to the sixth and seventh aspects of the disclosure. As such, Optionally, the pin elements are cams, Optionally, the pin elements comprise an outer cover formed of an elastomeric material, and Optionally, the first clamp portion comprises two cooperating pairs of adjacent pivotable pin elements.

The fabric clamp may be fixable to a head board or head end frame of the patient support device. Optionally, the mount is configured for engagement with an opening or space in a head board of the patient support device.

Optionally, the first clamp portion is adapted for clamping a sheet of the patient support device. As such, the fabric clamp may be a sheet gripper according to other aspects of the present disclosure.

The disclosure, in a ninth aspect, provides a patient positioning system for use with a patient support device having a base portion and a patient support deck which may support a mattress with a sheet thereon, the patient positioning system including a bar that is fixable to the head end of the patient support device and may be deployed to a position above or adjacent the patient support deck and allowing a sheet on the said mattress to pass thereunder, the system also including means for pulling the sheet on the mattress under the bar and then upwards and away from the head end of the mattress and towards the head end of the patient support device, the means including: a fabric clamp according to the eighth aspect of the disclosure, the fabric clamp being located above the bar and the top of a mattress on the patient support deck, and a motor for pulling a sheet held in the fabric clamp.

Optionally, the fabric clamp comprises two cooperating pairs of adjacent pin elements.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

Illustrative embodiments of the present disclosure will now be described by way of non-limiting example with reference to the accompanying figures in which:

FIGS. 10*a* and 10*b* are another alternative sheet gripper;

DETAILED DESCRIPTION

Figure 1A:
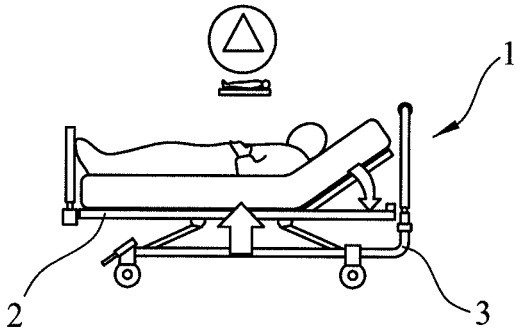
FIG. 1*a* is a diagrammatic side view of a hospital bed and patient positioning apparatus, the bar of the apparatus shown mounted in a stored position on the bed, and, the bed shown in a sitting position with a patient having slipped down towards the foot end of the bed.
Figure 1E:
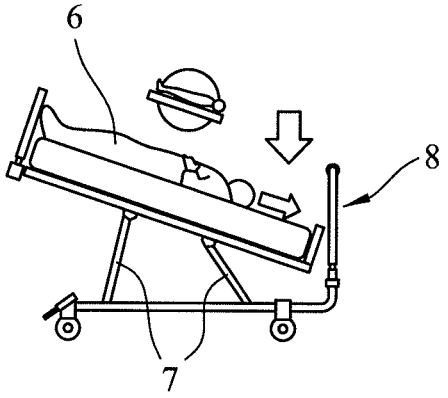
FIG. 1*e* is a diagrammatic side view illustrating the bed being maneuvered into the Trendelenburg position with its head end below the foot end to thereby pull the sheet and the patient thereon towards the head end of the bed.
Figure 1B:
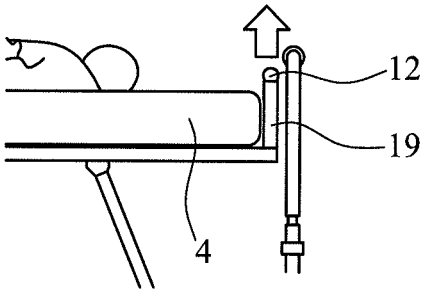
FIG. 1*b* is a diagrammatic fragmentary exploded side view of the head end of the hospital bed and patient positioning bar of the apparatus with the patient positioning bar of the apparatus in a deployed position, and the patient support surface in its flat position.
Figure 1F:
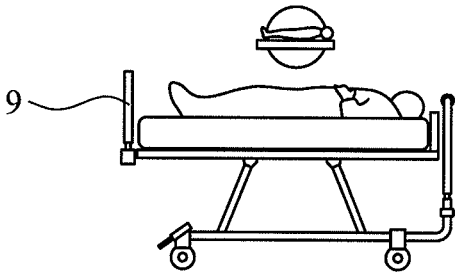
FIG. 1*f* illustrates the bed having been returned to its flat raised position with the patient repositioned towards the head end of the bed.
Figure 1C:
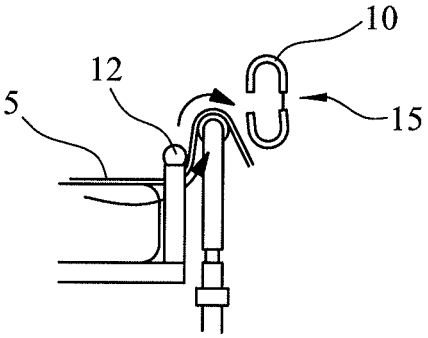
FIG. 1*c* is a diagrammatic fragmentary exploded perspective view of the apparatus showing the sheet on the mattress being positioned ready for engagement by the sheet gripper.
Figure 1D:
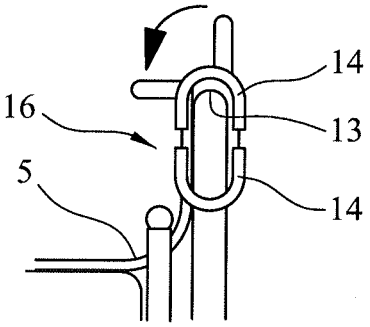
FIG. 1*d* is a diagrammatic view corresponding to FIG. 1*c* but with the sheet gripper in position gripping the head end of the sheet.
Figure 1G:
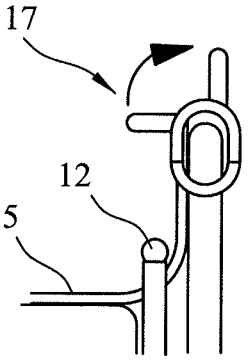
FIG. 1*g* is a diagrammatic illustration of the releasing of the sheet gripper once the repositioning is complete.
Figure 2:
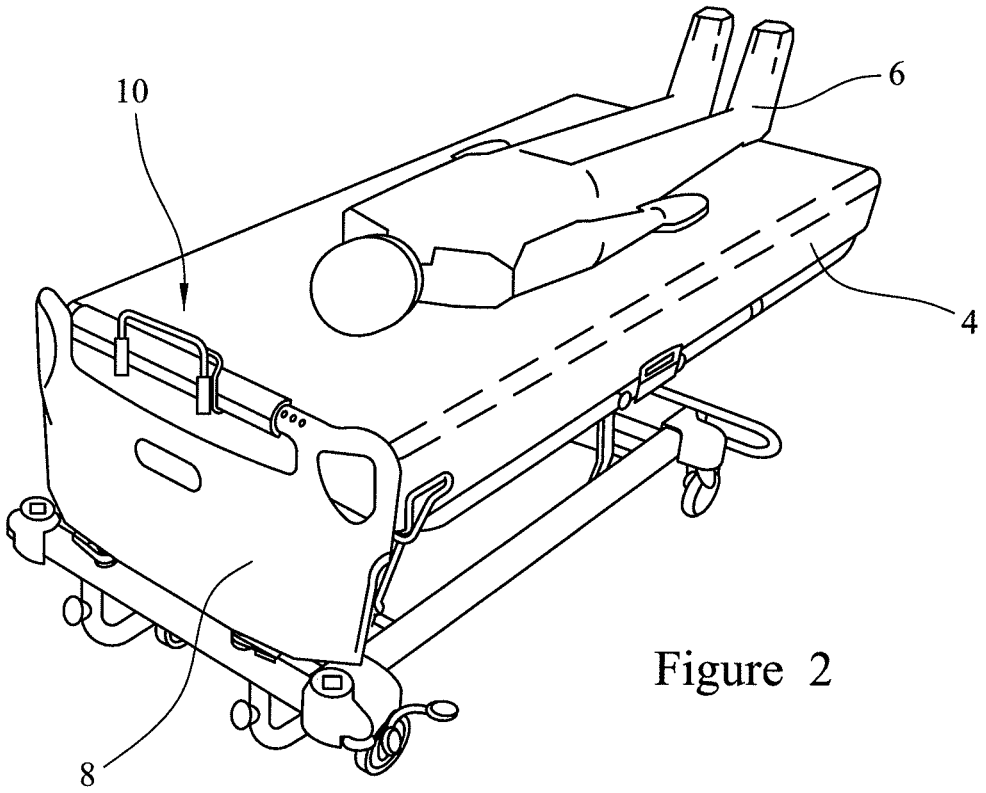
FIG. 2 is a perspective head end view of a bed including an embodiment of the disclosure with a sheet gripper on the head board.
Figure 7A:
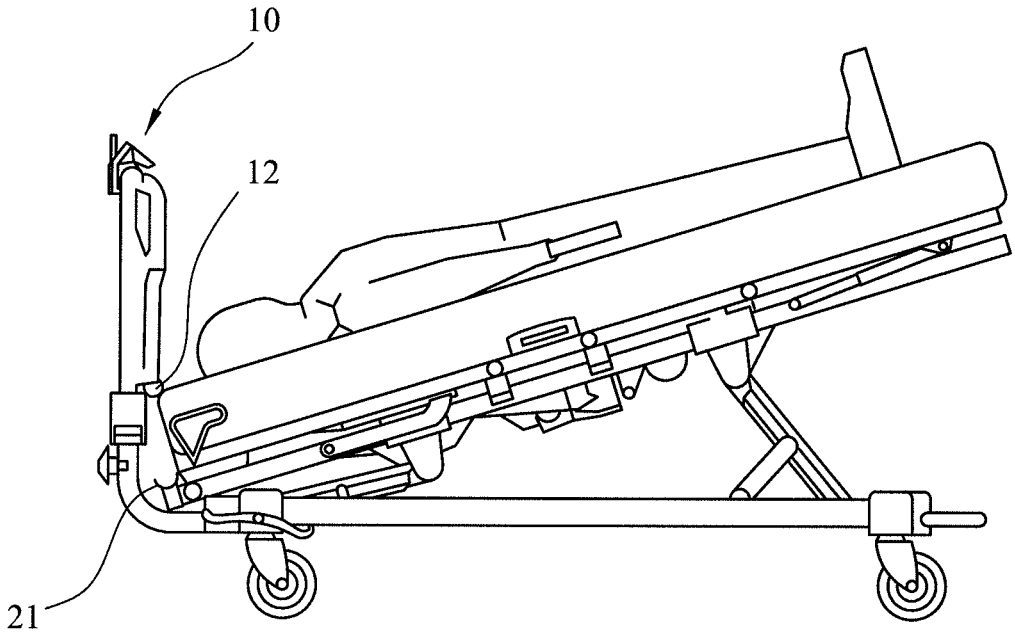
FIGS. 7*a* and 7*b* are, respectively, side and top views of the bed after it has moved from the raised position shown in FIGS. 6*a*, 6*b*, to the Trendelenburg position with the patient moved towards the head end.
Figure 8A:
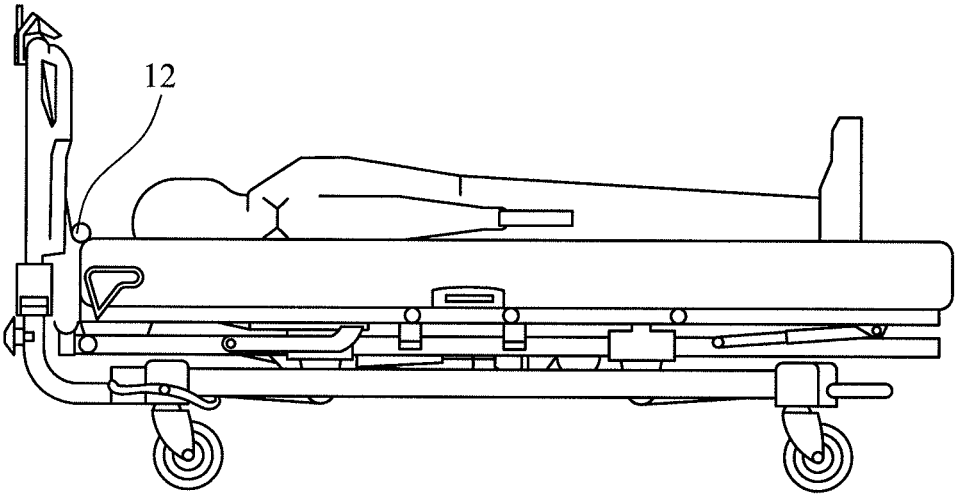
FIGS. 8*a* and 8*b* are, respectively, side and top views of the bed having moved from the Trendelenburg position shown in FIGS. 7*a*, 7*b*, to its lowered position.

A hospital bed 1 includes a patient support deck 2 coupled to a base portion 3 or lower frame portion for supporting a patient support deck above the floor (see, for example, FIGS. 1 and 2). The bed 1 includes a mattress 4 supported by the patient support deck 2. A sheet 5 is fitted around the mattress on which a patient 6 lies. The mattress 4 and deck 2 provide a patient support portion of the bed. The bed includes a pair of actuators 7 coupling the patient support deck 2 to the base portion 3 or lower frame portion. The actuators 7 are controllably moveable to move the patient support deck 2 among multiple positions. Such positions include a flat lowered deck position as shown in FIG. 8*a*, a flat raised deck position as shown in FIGS. 1*f*, 2, 3, 6*a*, 10, a so-called Trendelenburg position with the head end below the foot end as shown in FIGS. 13, 7*a* and an anti-Trendelenburg position (not shown) with the foot end above the head end. The patient support surface deck comprises various articulated portions arranged in the manner known in the art and driven by further actuators (not shown) which allow the bed deck surface to take up different orientations and as described in, for example, EP 1517662. These include a flat or supine position as shown in, for example, FIG. 2 and a seating position as shown in FIG. 1*a*.

The bed includes a head board or head frame portion 8 connected to the base or lower frame portion 3 of the bed, and a foot board or foot frame portion 9 connected and fixed to the patient support deck 2. Movement of the patient support surface relative to the base portion 3 therefore moves the patient support deck 2 also relative to the head end frame or head board 8.

A sheet gripper unit 10 is fixed to the top of the head end frame or head board, and a sheet bar or roller element 11 is fixed to the head end of the patient support deck 2. The sheet bar 11 unit comprises a substantially horizontal bar or roller 12 of circular cross-section with its longitudinal axis parallel to the head end of the mattress and bed (i.e. perpendicular to the longitudinal axis of the bed). The horizontal bar can be moved from a first stored position (see FIGS. 1*a* and/or 5 for example, in which the bar 12 is located adjacent the patient support deck 2, to a deployed position (see, for example, FIGS. 1*b* and/or 5*b*) in which it is located above and adjacent the head end of the mattress 4. In some embodiments, the deployed sheet bar unit is held with deployed position by the sheet passing thereunder which is fixed to the sheet gripper unit 10 described below. Alternatively, the sheet bar unit can be locked or fixed in place when deployed. In a further alternative, the deployed sheet bar 12 can be held in place by being placed on top of the head end of the mattress 4.

Figure 4A:
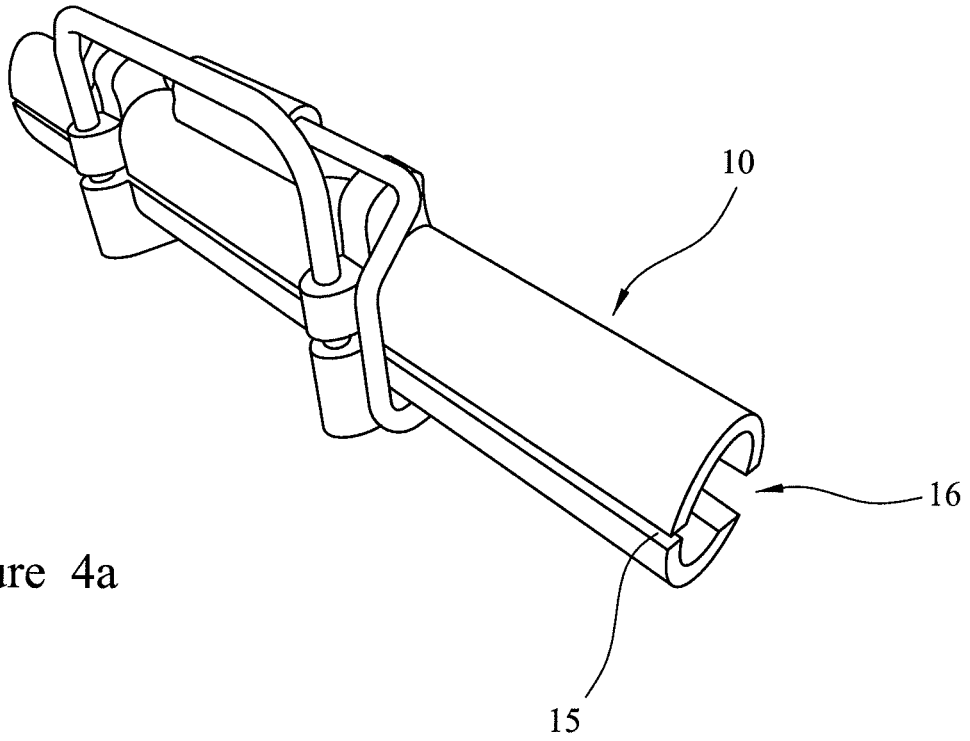
FIGS. 4*a* and 4*b* are detailed views of the sheet gripper of FIG. 2.
Figure 4B:
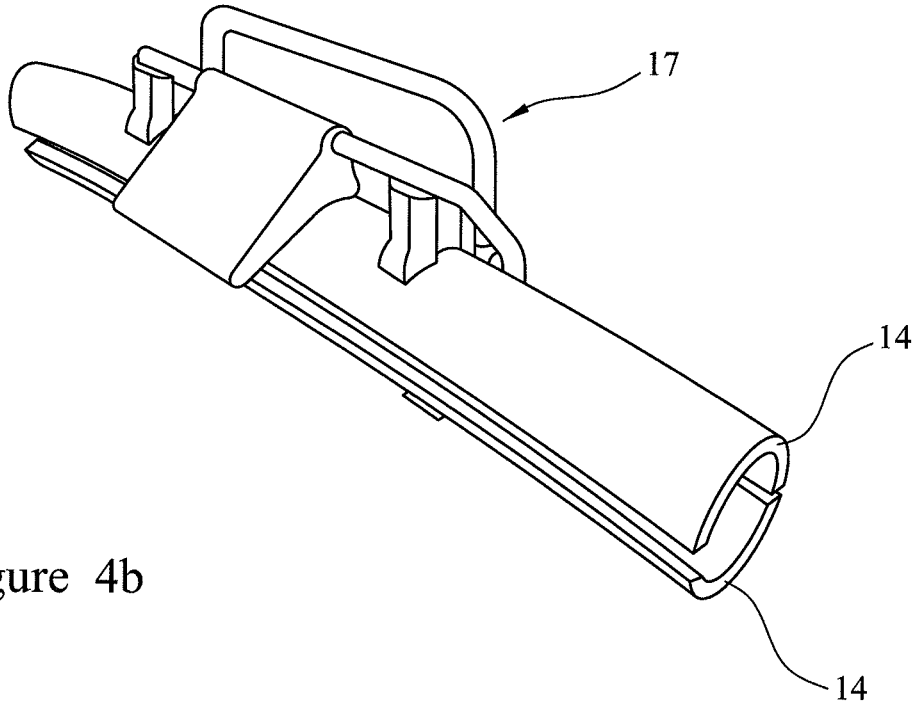

The sheet gripper unit 10 (see FIGS. 4*a*, 4*b*) may be mounted to a horizontal rod or frame element of the head board 8 such as the pushing handle element. Alternatively, it can be fixed to the head board by being glued, screwed, welded, or otherwise coupled thereto. The sheet gripper unit 10 comprises two channel elements 14 of a substantially U-shaped cross-section such that their internal surfaces correspond to, respectively, the top and bottom surfaces of the head board frame element 13 to which the sheet 5 is to be gripped (the pushing handle 13 in the described embodiments). The two channel elements 14 are pivotally connected along an edge 15 such that together they form a tubular element open along an edge 16 with its two halves 14 able to move relative to each other (arrow A in FIGS. 4*a*, 4*b*) to open and close the tubular element. The sheet gripper unit 10 also includes a cam locking unit 17 operable to lock the two channel elements 14 together and tightly around the head board frame element 13 and a sheet placed there against or around. An alternative sheet gripper unit (not shown) could be a clip element which clips tights around a portion of the head frame to hold in place a sheet placed around or against that head frame portion before the clip element is clipped to the head frame portion. Any arrangement which fixes a sheet to the head frame unit, or to another portion of the base frame may be used.

A sheet gripper unit 10 which fixes or grips the sheet to a portion of the base frame or base portion 10 above the mattress is described above. However, an alternative (not shown) is for the sheet to pass over the head board or head frame portion at a height above the mattress but then be fixed to a point or location lower down on the base portion 10.

Figure 5A:
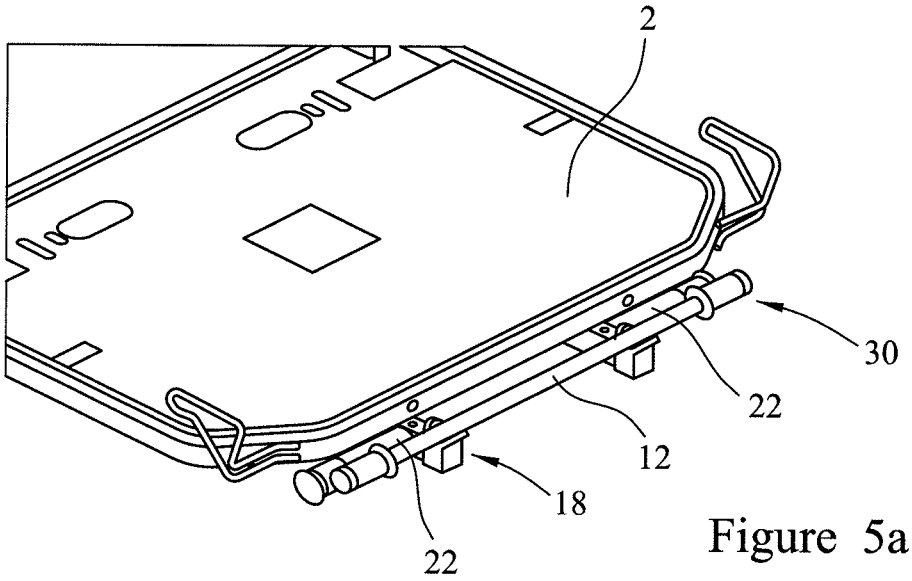
FIGS. 5*a* and 5*b* are detailed views of the sheet bar of FIG. 3.
Figure 5B:
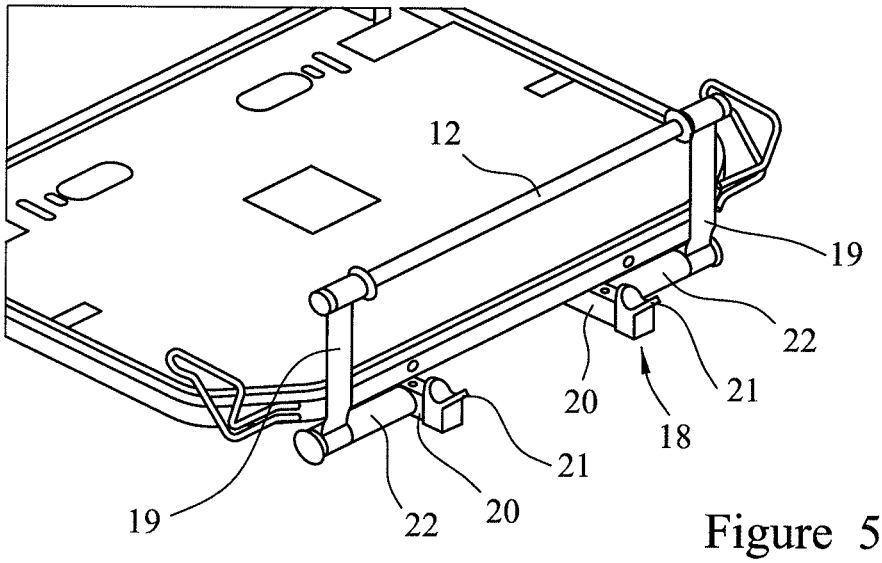
Figure 5C:
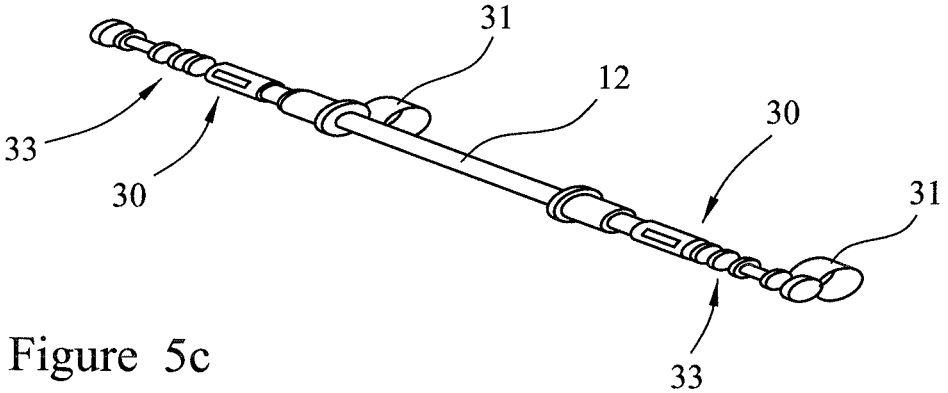
FIG. 5*c* is an exploded view of the bar of FIGS. 5*a* and 5*b;*
Figure 6A:
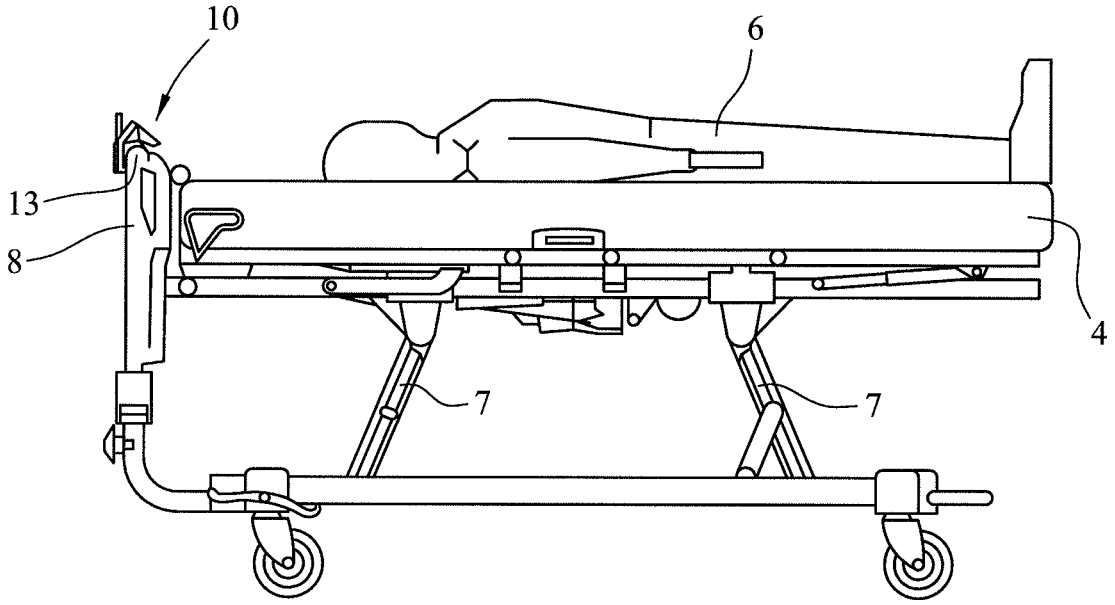
FIGS. 6*a* and 6*b* are, respectively, side and top views of the bed of FIG. 2 in its raised position with the sheet bar deployed and the bed in its raised position, and with a patient having slid down the bed towards the foot end.
Figure 6B:
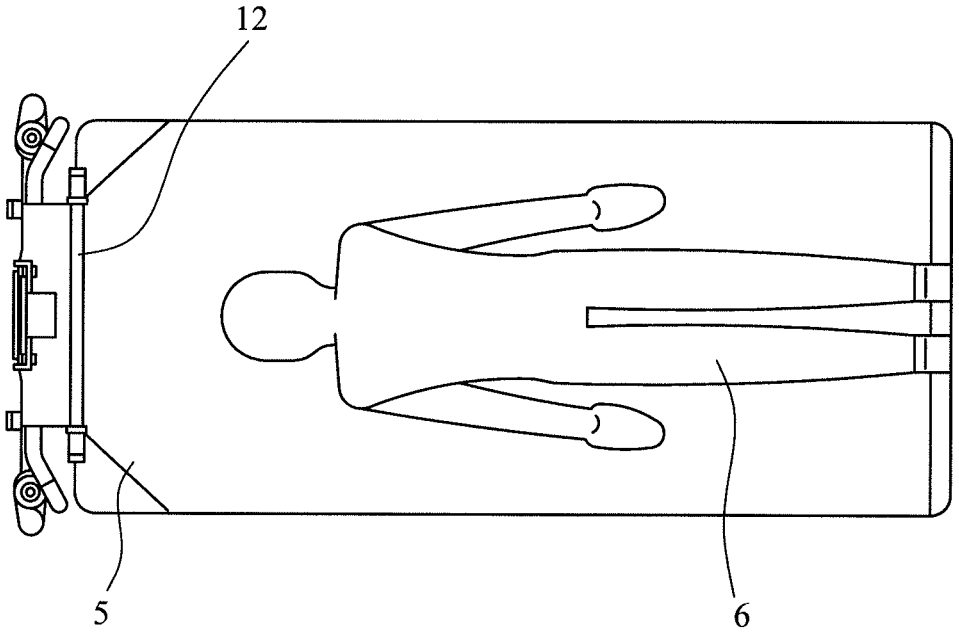

Referring to FIGS. 5*a* to 5*c*, the sheet bar unit 11 (which may be retrofitted to an existing bed) comprises a bar mount 18 fixed to the patient support deck 2 and a bar 12 coupled to the mount 18 by a pair of straps 19. The bar mount 18 comprises two arm elements 20 of rectangular cross-section fixed to the underside of the patient support deck 2. These arms 20 each include a distal cradle element 21 for holding or supporting the bar 12 (see FIG. 5*a*) when it is in its stored position and a projecting strap arm element 22 around which is looped a first end 23 of a bar strap 19. The arms 20 may be made from aluminum and the cradles 21 of a plastics material. The straps 19 may be made of a suitable fabric.

The bar 12 includes at each of its ends a spring loaded mounting 30. These each hold an end 31 of a respective strap 19 and include a slot 32 through which the respective strap end is fed. The mountings each include a spring box or mounting 33 which biases the shaft including the slot 32 to which the strap is fixed such that the strap is kept under tension and biased so that it is pulled towards the mount elements 20. In other words, the sheet bar unit includes a spring loaded or biasing element which keeps the straps 19 under tension and acts to pull the deployed bar towards its retracted position.

In an alternative embodiment (not shown) the sheet bar 11 coupled may be connected at its ends to two vertical support rods which move in guides in the bed and can be locked or held in position at the deployed bar position.

Figure 3:
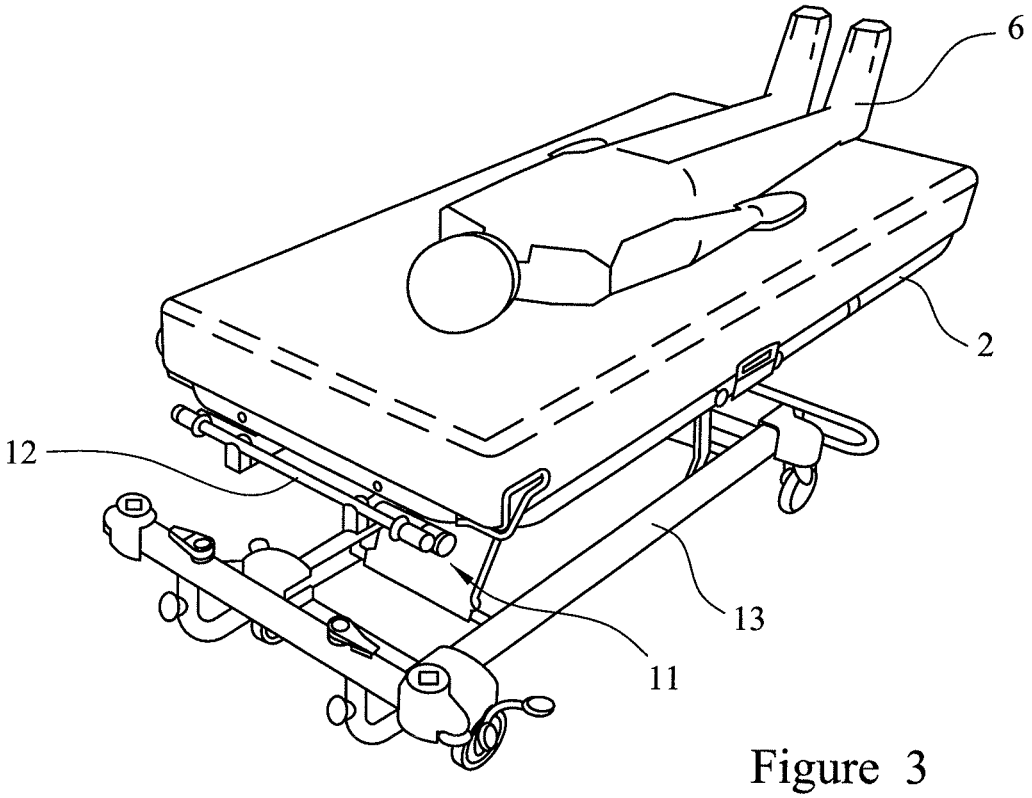
FIG. 3 is a view corresponding to FIG. 2 but with the head board removed to show the sheet bar in its stored position.
Figure 8B:
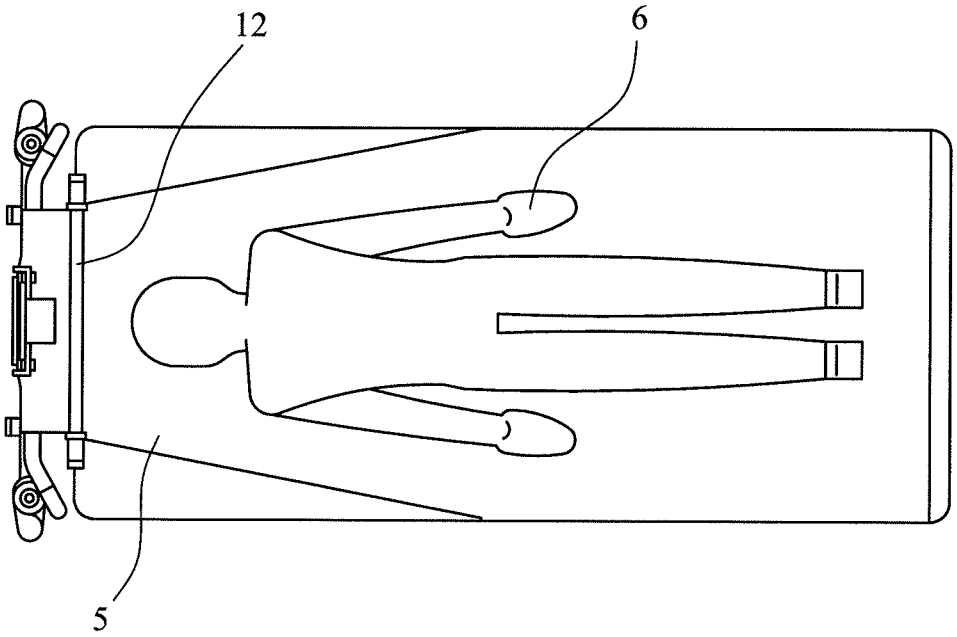
Figure 9A:
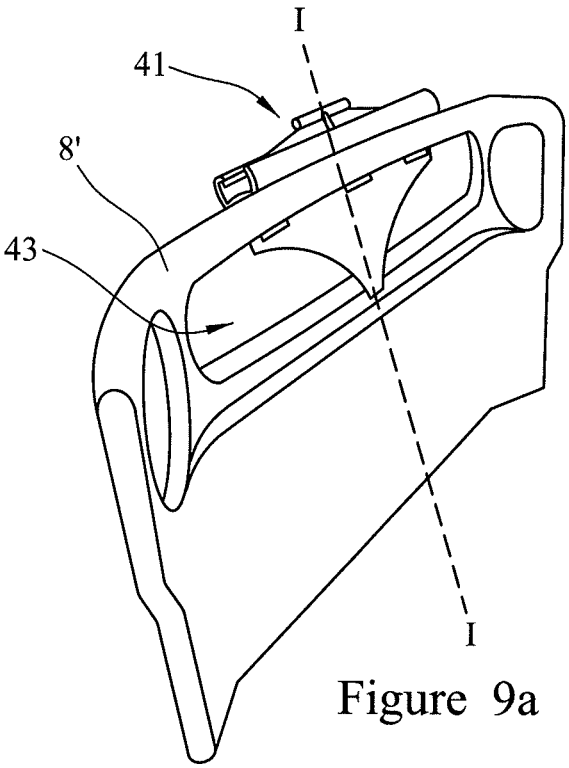
FIGS. 9*a*, 9*b*, 9*c* and 9*d* are, respectively, a perspective view of a sheet gripper mounted on a head board, a bottom perspective view of the sheet gripper, a top perspective view of the sheet gripper and a side cross-sectional view alone line I-I of FIG. 9*a*, all illustrating an alternative sheet gripper.
Figure 9B:
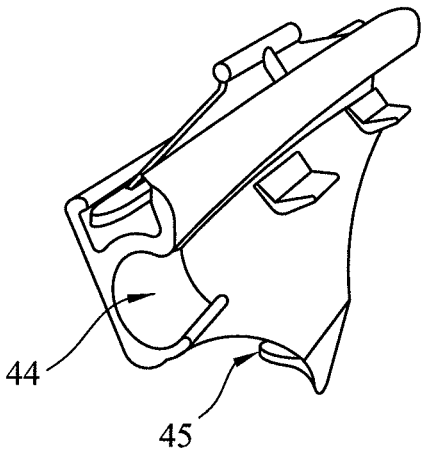
Figure 9C:
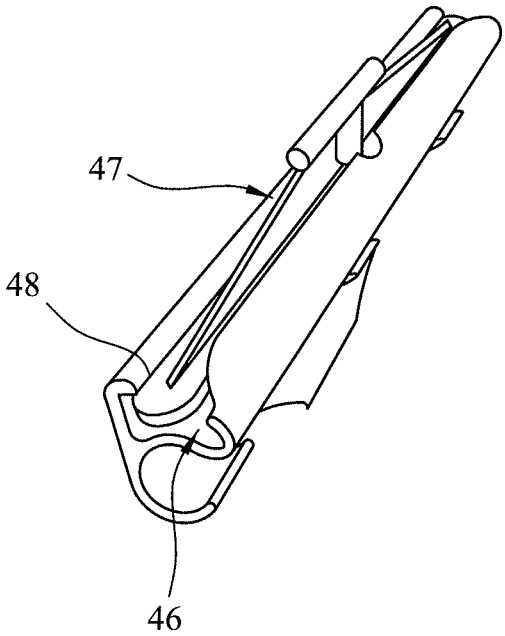
Figure 9D:
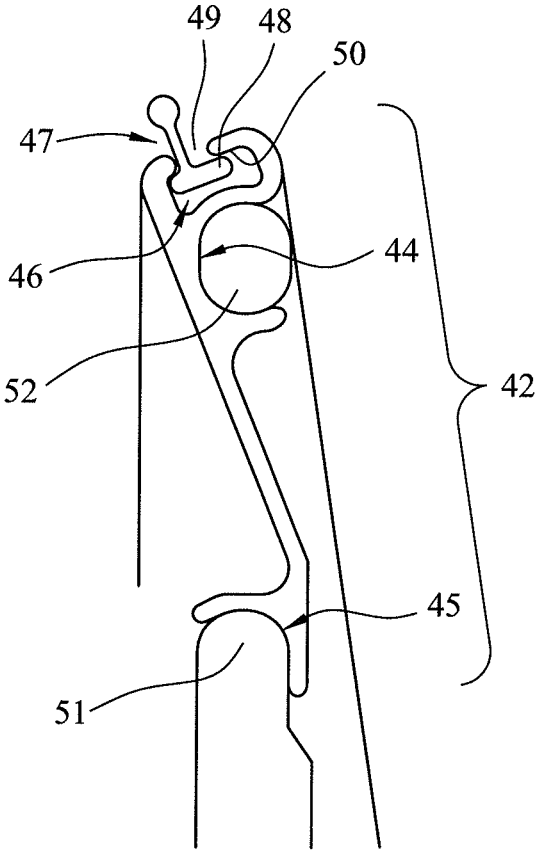

Referring to FIGS. 3, 4 and 8, the sheet gripper unit 10 is arranged to grip around the head end frame or head board 8. In the embodiment illustrated, the head end frame 8 includes an upper horizontal frame element 13 of substantially cross-section and running parallel to the head end of the mattress 4. The sheet gripper element is a two-part element which engages the top of the head frame portion.

Referring to FIGS. 1*a*, 2 and 3 which show a patient requiring repositioning, the patient support surface is arranged in a sitting position and the patient has slipped down the mattress 4 such that his or her feet are pushed against the foot end board or frame 9. The repositioning method starts by movement of the patient support surface into a flat position (FIGS. 1*b*, 2, 3, 6*a*, 6*b*) and a raising of the patient support deck 2 into its raised position. The sheet bar unit is then raised so as to take up a position with the bar 12 located slightly above the head end of the mattress 4.

Figure 7B:
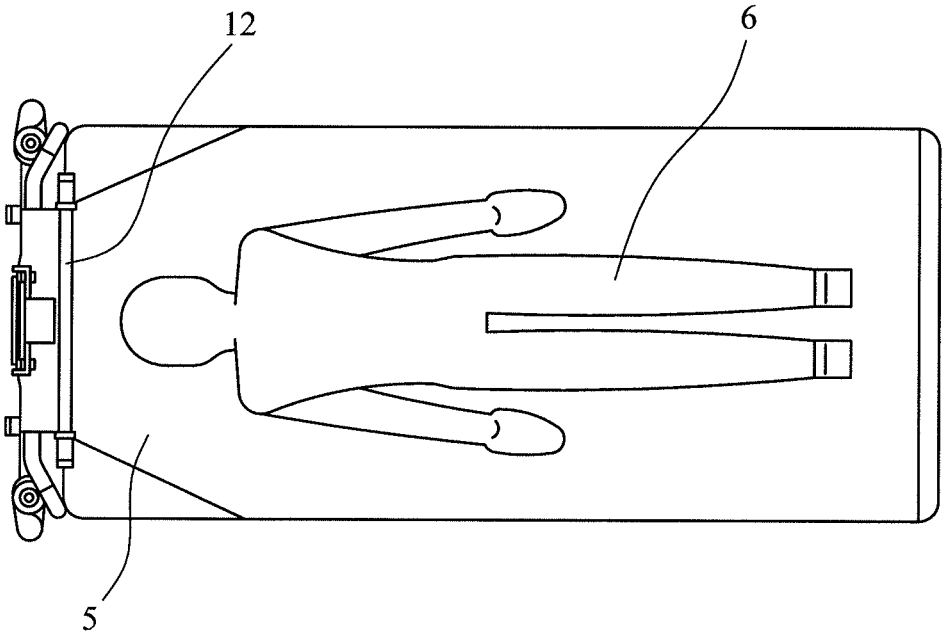

Referring to FIG. 1*c*, a care giver untucks the head end of the sheet 5 and pulls it through the sheet bar unit 11 under the horizontal bar 12 and places the head end of the sheet 5 over the top of the head board or head frame element 13. The sheet gripper 10 is then placed around and locked over the top of the head board or head frame to thereby hold the head end of the sheet 5 in position relative to the head frame or head board 8. The head end of the patient support deck 2 is then lowered such that the patient support surface is moved into the Trendelenburg position with the foot end above the head end (see FIGS. 1*e*, 7*a*, 7*b*). This moves the head end of the mattress 4 and hence the sheet bar unit 11 relative to the base portion 3 and the head board or head frame 8 fixed relative to the base portion 3. Movement downwards of the head end of the mattress 4 increases the distance between the head end of the mattress and the sheet bar 12 and the sheet gripper 10 such that the sheet 5 is pulled towards the head end of the mattress (see FIGS. 1*e*, 7*a*, 7*b*). This results in a repositioning of the patient towards the head end of the mattress. Once the repositioning step is complete, the patient support deck 2 can be returned to a flat position as shown in (see FIGS. 1*e*, 7*a*, 7*b*, and the sheet 5 released from the sheet gripper 10 and tucked back in under the mattress 4.

FIGS. 9*a*, 9*b*, 9*c* and 9*d* illustrate an alternative sheet gripper unit 41 for fixing (and/or retro-fitting) to a head board 8'. The sheet gripper unit includes a support 42 for engaging with and being held within the opening 43 in the head board 8'. The support 42 includes upper and lower head board engaging surfaces 44, 45 for fitting around and engaging complementary portions of the head board so as to be held in place on the head board. The sheet gripper unit 41 includes a longitudinal channel 46 in its upper surface which, when the sheet gripper unit is fixed on a head board has its longitudinal axis running parallel to the plane of the head board and therefore substantially transverse to the longitudinal axis of the bed 1. The sheet gripper unit 41 includes a rod or locking element 47 which is removable from and also lockable or fixed to within the channel 46. The locking element 47 has a protrusion 48 which can pass through a corresponding complementary opening 49 in the channel 46, and then slides under an upper edge 50 of the channel to hold the locking element in place.

The locking element is substantially L-shaped, comprising a handle at one end and a protrusion substantially perpendicular to the handle at the other end.

To position the locking element into the channel, a user holds the locking element by the handle and inserts the protrusion into channel through the opening. The user then rotates the locking element to engage the protrusion with the upper edge of the channel to secure the locking element in place.

A sheet can be held in the channel 46 of sheet gripper unit 41, between the locking element 47 and the channel 46.

To clamp a fabric between the channel and the locking member, a user removes the locking element from the channel and drapes a fabric over the opening of the channel. The user inserts the protrusion of the locking element into the channel through the opening, pushing the fabric into the channel through the opening. The user then locks the locking member in the channel by rotating the locking member to engage the protrusion with the upper edge of the channel, which clamps the fabric between the one or more protrusions and the channel.

The lower engaging surface 45 has a bottom curved surface for resting on and against the top and the inner side surface of the edge of the head board defining the lower edge 51 of the head board opening 43. The upper engaging surface 44 defines a sidewardly facing channel for receiving the handle portion of the head board which defines the top edges 52 of both the head board opening and the head board itself. The channel is substantially C-shaped and includes surfaces contacting and engaging upper and lower surfaces of the headboard handle portion, as well as the outward surface of that headboard handle portion. As such, the upper engaging surface 44 and the lower engaging surface 45 engage surfaces of the headboard opening 43 facing in opposite directions, the upper engaging surface 44 engaging an inward surface and the lower engaging surface 45 engaging an outward surface.

The C-shaped channel of the upper engaging surface 44 need not be continuous and in the embodiment shown in FIGS. 9*a* to 9*d* the lower portion of the channel is defined by three separated curved elements for engaging the lower surface of the headboard handle. The combination of the upper and lower engaging surfaces and the resilient support there between allows one to easily fit the channel of the upper portion of the sheet gripper unit to a headboard handle, then pivot it into the position shown in, for example, FIGS. 9*a* and 9*d* with the lower portion resting on the bottom edge of the headboard opening.

The support 42 and the locking element 47 are each formed from a resilient plastic material. Providing the sheet gripper unit 41 with a resilient plastic support enables the sheet gripper unit 41 to be snap fitted into the headboard opening 43 and held in place there. The forces acting on the sheet gripper unit 41 during movement of a sheet are primarily vertically downward so the C-shaped section provides a simple but strong means for mounting of the unit to the headboard.

FIGS. 10*a* and 10*b* show an alternative sheet gripper unit 61 similar to that described above in connection with FIGS. 9*a* to 9*c* insofar as the support or mounting mechanism to couple it to a head board is concerned. However, in the embodiment of FIGS. 10*a* and 10*b*, the mechanism for gripping a sheet comprises two pairs 62 of rotatable pin elements or cam rollers 63. Each pair 62 of cam rollers 63 is configured to grip a sheet arranged between the cam rollers 63

Each cam roller 63 is mounted on a pivot (not shown) at an upper surface of the mounting mechanism, in a similar position to the channel 46 of the gripper unit 41 shown in FIGS. 9*a*, 9*b*, 9*c* and 9*d*. The pairs 62 of cam rollers 63 are arranged at opposite ends of the upper surface of the mounting mechanism.

Each cam roller 63 is formed of a resilient plastic material, similar to the mounting mechanism, and has a cover (not shown) formed from an elastomeric material, such as rubber. The rubber cover provides a high friction outer surface for the cam rollers 63, to help the cam rollers 63 to grip a sheet. The rubber cover also provides some flexibility to the outer surface of the cam rollers 63, to substantially prevent damage to a sheet gripped between a pair 62 of the cam rollers 63.

The cam rollers 63 are lobed cams. As such, each cam roller 63 has a lower body portion and an upper lobed portion 64. The lower body portion of each roller 63 has a substantially circular cross-section and the upper lobed portion 64 of each cam roller 63 extends radially outwardly from the lower body portion and tapers to a narrow distal end. The pivot (not shown) about which each cam roller 63 rotates is aligned substantially with the center of the substantially circular lower body portion.

Each pair 62 of cam rollers 63 is arranged so that the upper lobe portions 64 of the opposing cam rollers 63 abut or come into contact as the cam rollers 63 are rotated in opposite, clamping directions A, A'. The position in which the lobed portions 64 of a pair 62 of cam rollers 63 make contact will be referred to as the clamping position. The pairs 62 of cam rollers 63 are shown in the clamping position in FIG. 10*a*.

Each one of the cam rollers 63 includes a spring mechanism (not shown) which forces the cam rollers 63 to rotate in the clamping directions A, A'. In this embodiment, the spring mechanism is a spiral torsion spring; however, it will be appreciated that the spring mechanism may be any other suitable spring mechanism. Each pair 62 of cam rollers 63 comprises a first roller having a spring mechanism that biases the first roller to rotate in a first clamping direction A, and a second roller having a spring mechanism that biases the second roller to rotate in a second clamping direction A', opposite the first clamping direction A. Rotating the cam rollers 63 of each pair 62 in opposite directions enables the lobed portions 64 of the rollers 63 to be brought together in the clamping position, at a position offset from the line connecting their respective centers of rotation, and push against each other in a direction towards the line connecting their respective centers of rotation. This enables the lobed portions 64 of a pair 62 of cam rollers 63 to pinch or clamp a sheet arranged between the rollers 63, as the opposing spring mechanisms urge the lobed portions 64 of the cam rollers 63 towards each other and towards the clamping position.

The pairs 62 of cam rollers 63 are arranged such that the clamping position is towards the outside of the patient support device. In other words, the lobe portions 64 of the cam rollers 63 of each pair 62 are arranged to come together or abut at a position above the pivots.

As shown in FIG. 10*b*, a sheet 5 from a patient support may be pushed between the pairs 62 of cam rollers 63 from below, rotating the cam rollers 63 in an opening direction, opposite to the clamping directions A, A'. This forces the cam rollers 63 to rotate out of the clamping position, and causes a gap to be formed between the opposing lobe portions 64, which is occupied by the sheet 5. Once the sheet 5 is positioned between the cam rollers 63, the spring mechanisms of the rollers 63 urge the rollers 63 to rotate in their respective, opposing clamping directions A, A'. This causes the lobe sections 64 of the opposing cam rollers 63 to push against each other on opposite sides of the sheet 5, which pinches and clamps the sheet 5 in place between the cam rollers 63.

The biasing of the spring mechanisms in the clamping direction provides an inward clamping force on the sheet 5. In addition, the rubber covers of the cam rollers 63 helps the rollers 63 to grip the sheet. The inward force and the grip of the rollers 63 on the sheet 5 causes movement of the sheet 5 to influence the rollers 63. As such, application of a force F on the sheet 5 in a downward direction, towards the foot end of the patient support, urges the cam rollers 63 to rotate further in their respective clamping directions A, A'. This urges the lobe portions 64 together, increasing the inward, clamping force applied to the sheet 5 by the lobed portions 64 of the cam rollers 63. As such, the pairs 62 of cam rollers 63 tend to grip the sheet 5 more firmly when a force F is applied to the sheet in a direction towards the foot end of the patient support. However, application of a force on the sheet in an opposite, upwards direction urges the cam rollers 63 to rotate in their respective opening directions, opposite the clamping directions. This facilitates insertion of a sheet between a pair of the cam rollers in one direction and inhibits withdrawal of the sheet from the pair of cam rollers in the opposite direction.

It will be appreciated that in other embodiments the cam rollers may not be lobed cams, but may be eccentric cam rollers. In other words, the cam rollers may not comprise lobe portions, but rather may have a circular cross-section or shape having an axis of rotational symmetry, and the pivot may be offset or spaced from the axis of rotational symmetry. In these embodiments, the pairs of cam rollers are arranged to abut or contact in the clamping position at the sides furthest from the pivots.

Figure 11A:
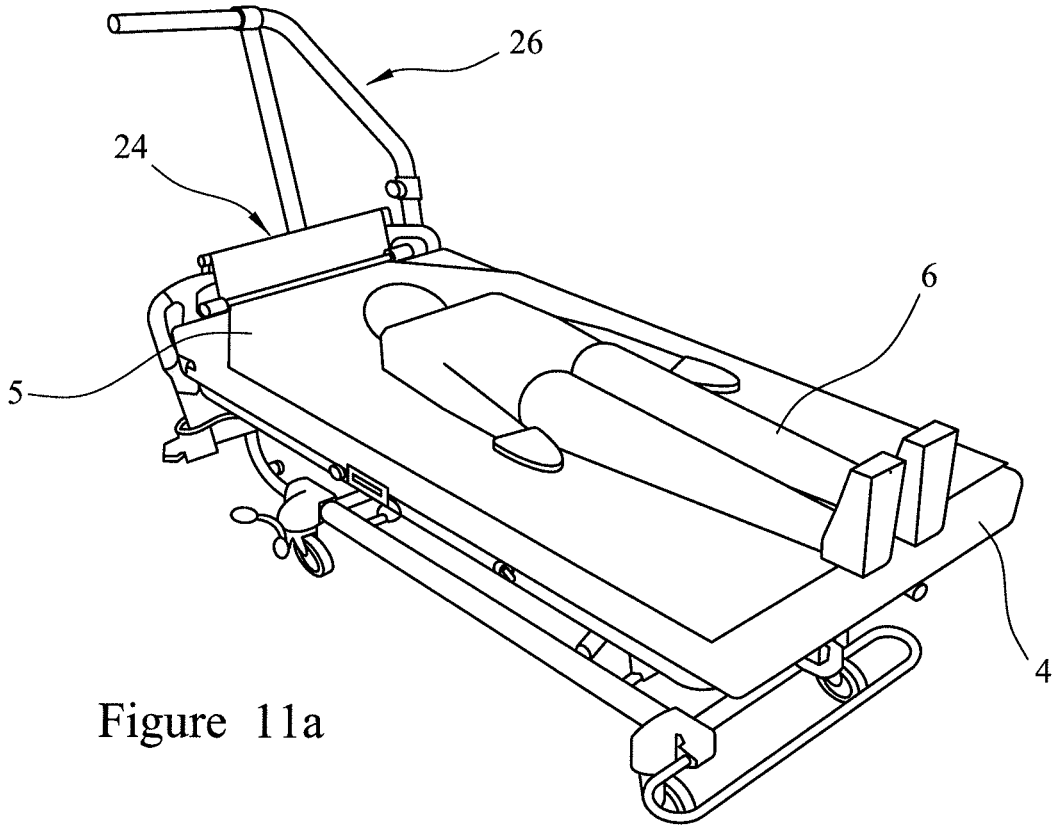
FIGS. 11*a*, 11*b*, and 11*c* are perspective views of further alternative sheet grippers.
Figure 12:
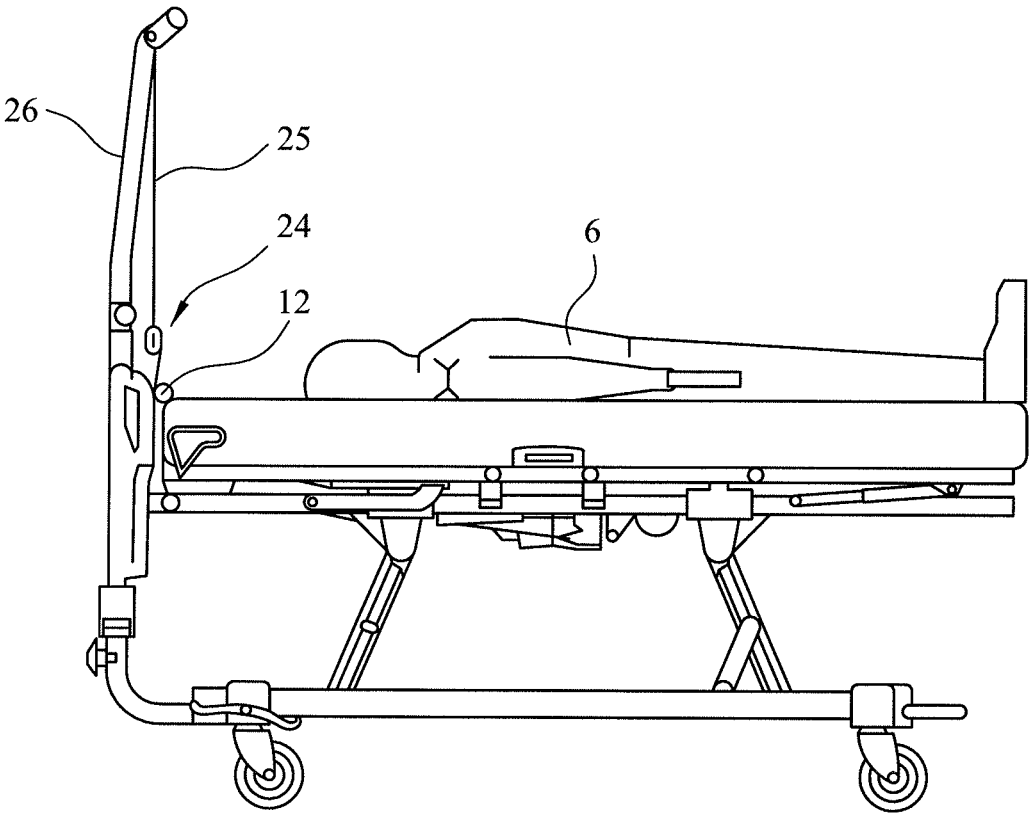
FIG. 12 is a side view of a bed incorporating the sheet gripper arrangement of FIG. 9*a*.

In the alternative embodiment shown in FIGS. 11*a* and 12, a sheet gripper clamp unit 24 can be coupled or connected to a patient helper or lifting frame 26 by a strap 25. The sheet gripper unit 24 could be a clamp and the strap 25 could alternatively be connected to the ceiling, wall or other surface or unit near the bed 1.

Figure 11B:
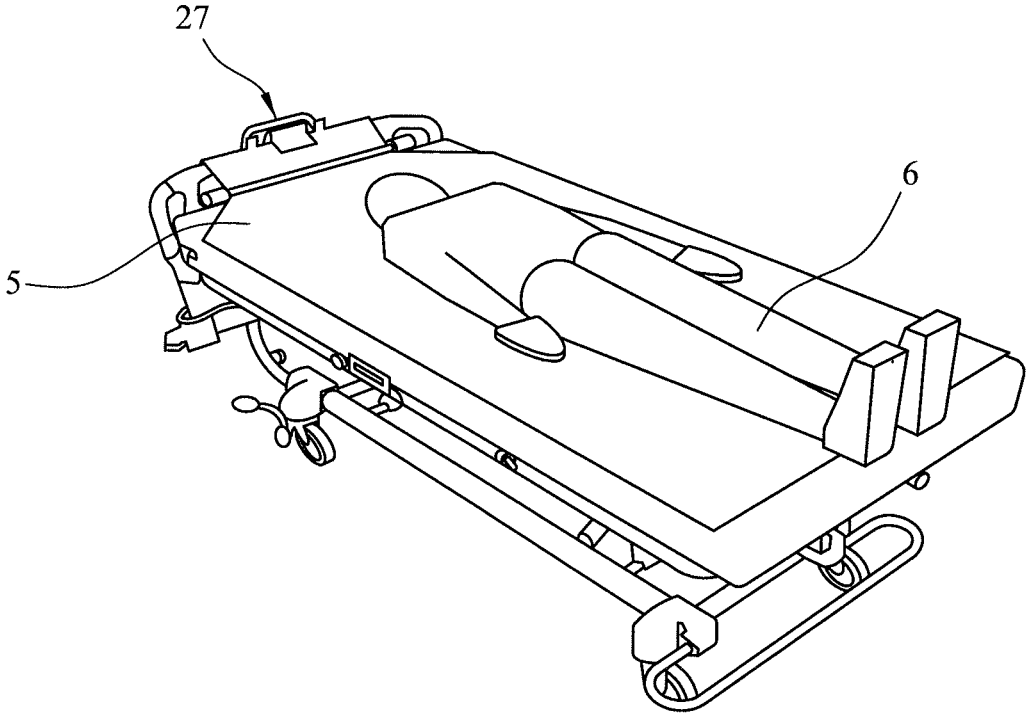
Figure 11C:
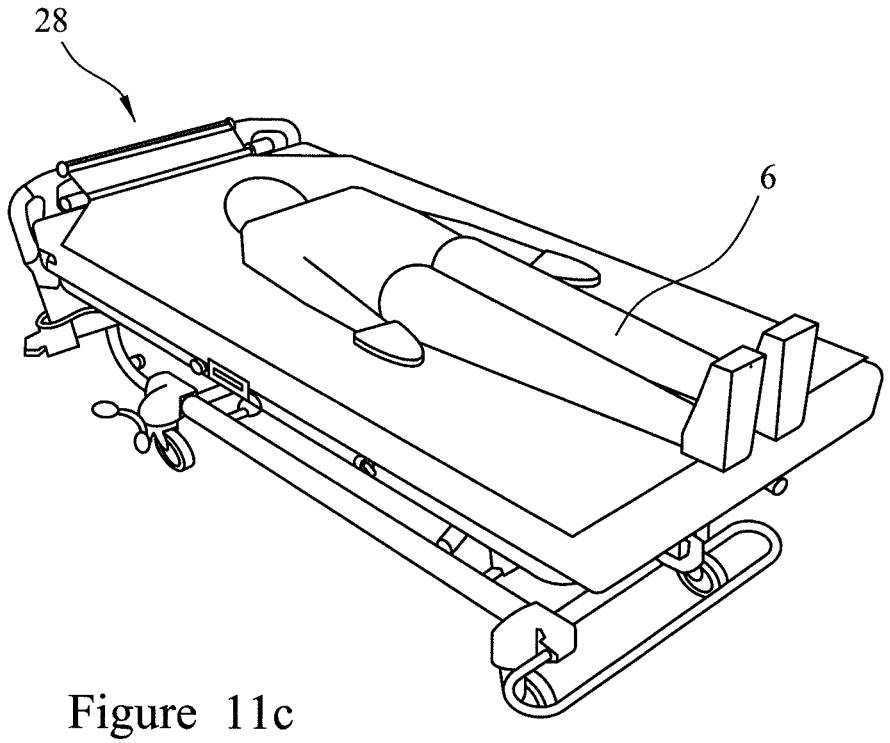

In the alternative embodiment shown in FIG. 11*b* a clamp unit 27 clamps the sheet 5 to the head board 8. The sheet gripper may be any element which fixes the sheet 5 and is able to hold it in tension. In the alternative embodiment shown in FIG. 11*c*, the clamp 28 rolls up the sheet 5 around the head board 8 to hold it in position and fixed relative to the head board.

In further alternative embodiments contemplated by this disclosure (not shown), the sheet gripper can be replaced by a sheet gripping unit on a fixed surface near the bed such as the wall behind the bed or another separate unit. In a further alternative embodiment the sheet can also be pulled through and under the sheet bar by a motorized sheet gripper arrangement which pulls the sheet up and away from the mattress.

Although certain illustrative embodiments have been described in detail above, variations and modifications exist within the scope and spirit of this disclosure as described and as defined in the following claims.

The invention claimed is:

1. A fabric clamp for use with a patient support device, the fabric clamp comprising a clamp portion for clamping a fabric, and a mounting portion for mounting the fabric clamp to the patient support device, wherein the clamp portion comprises a cooperating pair of adjacent pin elements, one of the pin elements being rotatable and the pin elements being arranged such that the rotatable pin element is rotatable in a clamping direction into a clamping position in which the pin elements are in contact with each other and in an opening direction, opposite to the clamping direction, out of the locking position in which a gap is provided between the pin elements, the rotatable pin element comprising a biasing element biasing the rotatable pin element in the clamping direction towards the clamping position.

2. The fabric clamp of claim 1, wherein the rotatable pin element comprises a cam.

3. The fabric clamp of claim 1, wherein the biasing element comprise a spring.

4. The fabric clamp of claim 1, wherein the rotatable pin element has a circular shape with an axis of circular symmetry, and the axis of rotation of the rotatable pine element is offset from the axis of circular symmetry.

5. The fabric clamp of claim 1, wherein the rotatable pin element comprises a lobed pin element, having a lobe portion extending substantially radially outwardly from the center of rotation of the pin element, the rotatable pin element being arranged such that the lobe portion contacts the other pin element in the clamping position.

6. The fabric clamp of claim 1, wherein at least the rotatable pin has an outer cover formed of an elastomeric material.

7. The fabric clamp of claim 1, wherein the pin elements are arranged such that one or more sheets of fabric are positionable between the pin elements and clamped between the pin elements as the rotatable pin is biased in the clamping direction towards the clamping position.

8. The fabric clamp of claim 7, wherein the pin elements are arranged such that pulling the one or more clamped sheets of fabric in a first direction relative to the pin elements tends to draw the rotatable pin element in the clamping direction towards the clamping position.

9. The fabric clamp of claim 8, wherein the pin elements are arranged such that pulling the one or more clamped sheets of fabric in a second direction relative to the pin elements, opposite the first direction, draws the rotatable pin element in the opening direction away from the clamping position.

10. The fabric clamp of claim 1, wherein both pin elements are rotatable, and both pin elements comprise a biasing element biasing the pin element in the clamping direction towards the clamping position, the clamping direction of one of pin elements being opposite to the clamping direction of the other one of the pin elements.

11. The fabric clamp of claim 1, further comprising at least two cooperating pairs of adjacent pin elements.

12. The fabric clamp of claim 1, wherein the mounting portion is configured for engagement with an opening or space in a headboard of the patient support device.

13. The fabric clamp of claim 1, wherein the clamp portion is adapted for clamping a sheet of the patient support device.

* * * * *